US009758909B2

(12) United States Patent
Paradis et al.

(10) Patent No.: US 9,758,909 B2
(45) Date of Patent: Sep. 12, 2017

(54) COATED GLASS REINFORCED FACER

(71) Applicant: JOHNS MANVILLE, Denver, CO (US)

(72) Inventors: Duane Paradis, Highlands Ranch, CO (US); Guodong Zheng, Highlands Ranch, CO (US); Jawed Asrar, Englewood, CO (US)

(73) Assignee: Johns Manville, Denver, CO (US)

( * ) Notice: Subject to any disclaimer, the term of this patent is extended or adjusted under 35 U.S.C. 154(b) by 687 days.

(21) Appl. No.: 14/177,295

(22) Filed: Feb. 11, 2014

(65) Prior Publication Data

US 2015/0225881 A1 Aug. 13, 2015

(51) Int. Cl.

| | |
|---|---|
| ***D04H 1/00*** | (2006.01) |
| ***D04H 1/50*** | (2012.01) |
| ***D04H 1/40*** | (2012.01) |
| ***D04H 5/00*** | (2012.01) |
| ***D04H 1/593*** | (2012.01) |
| ***D04H 1/4218*** | (2012.01) |
| ***D04H 5/04*** | (2006.01) |
| ***D04H 5/12*** | (2012.01) |

(52) U.S. Cl.

CPC ..... *D04H 1/593* (2013.01); *D04H 1/4218* (2013.01); *D04H 5/04* (2013.01); *D04H 5/12* (2013.01); *Y10T 156/10* (2015.01); *Y10T 442/608* (2015.04)

(58) Field of Classification Search

CPC .. D04H 1/00; D04H 1/50; D04H 1/59; D04H 1/59; D04H 1/593; D04H 1/40; D04H 1/42; D04H 1/42; D04H 1/421; D04H 1/421; D04H 1/4218; D04H 5/00; D04H 5/04; D04H 5/10; D04H 5/12

See application file for complete search history.

(56) References Cited

U.S. PATENT DOCUMENTS

| | | | | |
|---|---|---|---|---|
| 7,833,638 | B2 * | 11/2010 | Zheng | B32B 13/14 428/432 |
| 8,568,544 | B2 * | 10/2013 | Engbrecht | B32B 13/14 156/39 |
| 2004/0209074 | A1 * | 10/2004 | Randall | B28B 19/0092 428/341 |

* cited by examiner

*Primary Examiner* — Jacob T Minskey
*Assistant Examiner* — Matthew Hoover
(74) *Attorney, Agent, or Firm* — Robert D. Touslee

(57) ABSTRACT

According to one embodiment, a method of forming a facer includes forming a first layer of nonwoven glass fibers and positioning a second layer of reinforcement fibers atop the first layer of nonwoven glass fibers. The method also includes coating the first layer of nonwoven glass fibers and/or the second layer of reinforcement fibers with a binder composition and pressing the first layer of nonwoven glass fibers and the second layer of reinforcement fibers together between a pair of rollers. The binder composition is then dried to couple the first layer of nonwoven glass fibers and the second layer of reinforcement fibers to form the facer. The first layer of nonwoven glass fibers and/or the second layer of reinforcement fibers are free of a material coating prior to coating of the binder composition.

27 Claims, 4 Drawing Sheets

COATED GLASS REINFORCED FACER

BACKGROUND OF THE INVENTION

Facer materials are commonly attached to composite and other boards for a variety of reasons. For example, the facer materials may be used to enhance the mechanical properties of the board and/or provide a desired visual appearance. A common use of facer materials is mats of bonded fibers that are attached to ceiling panels to enhance the aesthetic appeal, strength, sag resistance, and/or flame resistance of the ceiling panels. These ceiling panels are then often installed in suspended ceilings by inserting the ceiling panels into frames of the suspended ceiling. The facer products are attached to the side of the ceiling panel facing the room's interior to enhance the aesthetic appearance of the room. Another application of facer materials is in roofing boards that may be subjected to relative high wind loads. The facer material may be attached to the roofing board to increase the tensile strength of the board and thereby help prevent the board from being damaged by wind uplift loads. Various other uses of facer materials are known in the art.

BRIEF SUMMARY OF THE INVENTION

The embodiments described herein provide facers that may be coupled with composite boards for various purposes. According to one embodiment, a method of forming a facer for bonding with a composite board is provided. The method includes providing a nonwoven fiber mat and a plurality of reinforcement yarns. The nonwoven fiber mat includes a plurality of interwoven glass fibers and may have a weight of between 0.9 lb/sq and 4 lb/sq, where a sq is equal to about 100 $ft^2$. The reinforcement yarns may be arranged between about 3 and 10 yarns per inch, and more commonly 6 and 10 yarns per inch, and may have an average diameter of between 4 and 13 microns, and more commonly between 7 and 9 microns. The nonwoven fiber mat and the reinforcement yarns may be coated with a binder composition. The coated nonwoven fiber mat and the reinforcement yarns are pressed together between a pair of roller nips and the nonwoven fiber mat and the reinforcement yarns are dried to remove the water from the adhesive composition and thereby couple the nonwoven fiber mat and the reinforcement yarns together to form the facer. The binder composition may be substantially uniformly dispersed throughout the coupled nonwoven fiber mat and reinforcement yarns. Examples of the binder composition include organic binders such as latex polymers (e.g., a polyvinylacrylate latex), and inorganic binders that are made primarily of silicates (e.g., sodium silicates), but may also include a minor amount of organic polymer for increased flexibility. The binder composition may include 50 and 75% solids and between 25 and 50% water.

In some embodiments, coating the nonwoven fiber mat and the reinforcement yarns may include applying the binder composition prior to pressing the coated nonwoven fiber mat and the reinforcement yarns together. In such embodiments, applying the binder composition may include spraying the composition onto the nonwoven fiber mat or onto the reinforcement yarns or onto both materials. In other embodiments, coating the nonwoven fiber mat and the reinforcement yarns may include applying the binder composition while pressing the nonwoven fiber mat and the reinforcement yarns together. In such embodiments, applying the binder composition may include coating one or more of the roller nips with the composition.

In some embodiments, the method may further include adhering the facer to a composite board. The composite board may include one or more of the following materials: foam, gypsum, wood fiber, perlite, cement, and the like. The process of adhering the facer to the composite board may be integrated or combined with the process of forming the composite board and/or the process of forming the facer. In some embodiments, the method may additionally include controlling the coating of the binder composition of the coupled nonwoven fiber mat and reinforcement yarns by controlling the pressure exerted on the materials by the roller nips and/or controlling a gap between the roller nips.

In some embodiments, a knife or blade can be used in place or in addition to the roller nips to meter the coating of the binder composition while combining the nonwoven fiber mat and reinforcement yarns. In some embodiments, a puddle of the binder composition may be positioned behind a flexible blade or knife. In such embodiments, the flexible blade or knife may press the nonwoven fiber mat and reinforcement yarns together and the binder composition may be applied immediately after the materials are pressed together. In another embodiment, a knife or blade may be positioned distally of the roller nips to meter excess binder composition coating and/or produce a smoother surface. In some embodiments, the coating of the binder composition may be controlled by controlling the pressure of a flexible (or rigid) blade that contacts the nonwoven fiber mat and/or reinforcement yarns. A flexible knife may be preferred over a rigid knife due to the mineral fillers and rough surface created by reinforcement yarn layer.

According to another embodiment, a method of forming a facer is provided. The method includes forming a first layer of nonwoven glass fibers and positioning a second layer of reinforcement fibers atop the first layer of nonwoven glass fibers. The method also includes coating the first layer of nonwoven glass fibers and/or the second layer of reinforcement fibers with a binder composition, the first layer of nonwoven glass fibers and/or the second layer of reinforcement fibers being free of a material coating prior to coating of the binder composition. The method further includes pressing the first layer of nonwoven glass fibers and the second layer of reinforcement fibers together between a pair of rollers and drying the binder composition to couple the first layer of nonwoven glass fibers and the second layer of reinforcement fibers to form the facer.

In some embodiments, the binder composition may be dispersed substantially uniformly throughout the facer. In other embodiments, the facer may have a greater concentration of the binder composition within the first layer of nonwoven fibers or within the second layer of reinforcement fibers. In such embodiments, the concentration of the binder composition may be varied through the facer by applying the binder composition to either the first layer of nonwoven fibers or the second layer of reinforcement fibers, but not both layers, prior to pressing the layers together. In some embodiments, coating the nonwoven fiber mat and the reinforcement yarns may include applying the binder composition prior to pressing the coated materials together. In other embodiments, coating the first layer of nonwoven glass fibers and/or the second layer of reinforcement fibers may include applying the binder composition while pressing the layers together.

According to another embodiment, a facer for a composite board is provided. The facer includes a nonwoven fiber mat having a plurality of nonwoven glass fibers and a weight of between 0.9 lb/sq and 4 lb/sq. The facer also includes a plurality of reinforcement yarns that are positioned on at least one surface of the nonwoven fiber mat and coupled therewith. The reinforcement yarns may be arranged between about 6 and 10 yarns per inch and may have an average diameter of between 0.04 and 13 microns. The facer further includes a coating of an binder composition that couples the nonwoven fiber mat and the plurality of reinforcement yarns together upon drying of the composition. The facer is free of any other material coating prior to drying of the binder composition.

In some embodiments, the adhesive material coating is substantially uniformly dispersed throughout the coupled nonwoven fiber mat and reinforcement yarns. In other embodiments, the coating of the binder composition has a substantially greater concentration in either the nonwoven fiber mat or reinforcement yarns. The facer may have or exhibit a strength of at least 60 lbs/in.

According to another embodiment, a facer is provided. The facer includes a first layer of nonwoven glass fibers and a second layer of reinforcement fibers positioned on at least one surface of the first layer of nonwoven glass fibers. The facer also includes a coating that couples the first layer of nonwoven glass fibers and the second layer of reinforcement fibers together such that the facer is free of a layer of binder composition between the first layer and the second layer.

In some embodiments, the coating is substantially uniformly dispersed throughout the first layer and the second layer. In other embodiments, the coating is concentrated in the first layer or the second layer. Normally at least some coating layer is present within the second layer to ensure that the first and second layers adhere. In some embodiments, the coating is applied to opposite sides of the facer to ensure that the first and second layer are completely engulfed in the coating material.

BRIEF DESCRIPTION OF THE DRAWINGS

The present invention is described in conjunction with the appended figures.

Figure 1:
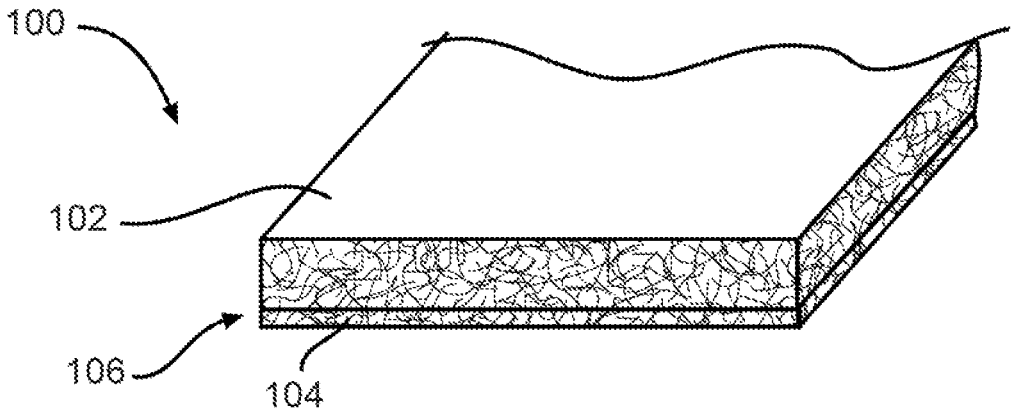
FIG. 1 illustrates a an embodiment of a facer (i.e., CGRF facer) that may be coupled with a composite board to enhance the mechanical properties of the board, the visual appearance of the board, or for various other reasons.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

The embodiments described herein provide facers that may be coupled with composite boards for various purposes. As used herein, the term facer generally means a material layer that is attached to one or more surfaces of a board for asthetic, strength, and/or other purposes. The facers are often fabric or textile materials that are attached to the boards. The fabric or textile materials may include woven or nonwoven fibers. For example, nonwoven glass fiber mats are often used as facers and coupled with composite boards to increase the strength of the boards or provide a desired exterior finish or look. Other fiber materials may also be used, such as polymer fibers (e.g., polyester, polypropylene, and the like), organic fibers, and the like. For ease in describing the embodiments herein, the disclosure will generally refer to the facers as being glass fiber mats or otherwise including glass fibers. It should be realized, however, that other fiber mats may be used and/or the facer may include other fiber materials in addition to, or in place of, the glass fibers.

In forming the facer, the glass fibers are often coated with a binder composition, which is dried to bond or adhere the glass fibers together to form the facer. The facer may be coated with one or more other materials and is commonly referred to as a coated glass facer (i.e., CGF). The binder composition used to bond the glass fibers may be an organic binder such as a latex polymer composition, or it may be an inorganic binder, such as a silicate-containing binder. The binder composition may be applied to the glass fibers such that the binder composition comprises a significant weight percentage of the resulting CGF mat. In some embodiments, the binder composition may comprise between 60 and 95% of weight of the mat. In addition to bonding or adhering the glass fibers, in some embodiments, the binder composition, or another coating material, may include one or more filler materials that enhance the mechanical properties of the facer and/or the visual appearance of the facer. For example, the binder composition may include a fire retardant, water repellant, pigment, and the like to enhance the facers ability to resist burning, to repel water, or to achieve a desired color or appearance, and the like. When considering foam, gypsum, wood fiber, perlite and cement composite boards, facers can significantly improve the mechanical properties, fire resistance, surface finish, and aesthetics of such boards. Various other characteristics of the facer may be enhanced depending on the filler material used.

In one embodiment, the facer may be attached to a composite board (e.g., foam, gypsum, wood fiber, perlite, cement, and the like) to increase the strength of the board. The composite board may be positioned or located in areas in which the board is subjected to various stresses such as from wind loading, loading due to attachment or contact with external objects, and the like. In the building/construction industry, facers for board products are commonly required to have a high tensile strength, impact resistance, and/or pull through resistance. In such instances, it may be desirous to increase the tensile strength of the facer by reinforcing the facer. The tensile strength of the facer may be improved by bonding or adhering a scrim or weaved yarn material to one or more surfaces of the facer. As used herein, the term scrim typically refers to a layer of threads or yarns, which are typically composed of strands of entangled fibers, that are arranged in one or more directions. For example, the threads or yarns are often woven together in a machine and cross-machine direction. The scrims may include an 6×6, 8×8, 10×10, and the like arrangement of the threads or yarns per square inch. The yarns may also be applied or woven in a diagonal direction. The fibers of the yarns or threads may include glass fibers, polyester fibers, polymer fibers, or other filaments. For ease in describing the embodiments, the reinforcement layer will be referred to generally herein as a scrim, scrim layer, reinforcement layer, or layer of reinforcement yarns.

The scrim or reinforcement layer may be coated with a the same binder composition as the glass mat, or may be coated with a different composition. The binder composition may bond the yarns/threads together. The scrim or reinforcement layer may then be adhered or tacked to the glass mat facer, often by applying an adhesive or adhesive layer (e.g., a latex adhesive, a silicate-containing adhesive, etc.) between the coated glass mat and the coated scrim/reinforcement layer. The resulting facer is a coated glass reinforced facer (CGRF). Conventional CGRF facers are essentially a composition of various layers: the coated glass mat layer, the coated scrim layer, and the adhesive layer between the previous two layers. Conventional CGRF facers typically do not include a single binder composition that is dispersed throughout the CGRF facer, and thus, the glass mat and scrim are not encapsulated within the binder composition.

In many embodiments, higher strength facers (i.e., CGRF) that enhance the physical properties of the boards enable lower overall product costs by reducing the amount of material contained in the board's core and/or by reducing cost of materials used to produce the core. This is particularly true for foam composite boards. For example, thinner foam composite boards (e.g., ½ inch or less) may benefit the most from CGRF facers. For example, a ¼ inch thick roof cover board faced with a standard coated glass facer (i.e. CGF) typically achieves a wind uplift rating of 90 lb/ft$^2$ with 1 fastener every 2 ft$^2$. If the same board is constructed with a CGRF facer, a 90 lb/ft$^2$ wind rating can be achieved with 1 fastener per 2.7 ft$^2$ or more depending on the reinforcement layer used for the facer. In another example, a foam composite tile underlayment board can achieve a 50% greater fastener holding strength and improved floor ratings when CGRF facers are utilized. In some embodiments, an improvement of over 100% fastener holding strength may be achieved when compared with conventional CGF facers. Other board applications require high strength, light weight and improved fire performance. In such instances, CGRF facers can achieve all three requirements by proper selection of glass mat weight, type and size of reinforcement yarns, coating composition and weight, and the like.

Additional benefits or improvement of CGRF facers can be realized by simultaneously adhering and coating the glass mat and scrim/reinforcement layer, or coating and adhering these materials in single step. Stated differently, benefits or improvements can be realized by using a single coating material that functions to both coat the glass mat and scrim/reinforcement layer and to bond or adhere these materials. The resulting mat in such a process has a single coating layer rather than the multiple coating layers described above (i.e., the coated glass mat layer, the coated scrim layer, and the adhesive layer). In such embodiments, the binder composition for the glass mat also functions as the binder composition for the scrim/reinforcement layer, and binds together the glass mat and scrim/reinforcement layer. Exemplary binder compositions may be inorganic binder compositions that include inorganic compounds such as those described in greater detail below. In the present application, the binder composition may also be described as a coating, a binder coating, an adhesive coating, and/or an adhesive material. The binder, coating, or adhesive may also be described as a "single" binder, coating, or adhesive, where the term "single" means that the same material functions as the coating for both the glass mat layer and scrim/reinforcement layer, and as the adhesive between these layers. The term "single" contrasts with "multiple" binders, coatings, or adhesives in which the glass mat and scrim/reinforcement layer are separately coated with binder compositions, and then adhered to each other with a different binder or adhesive layer.

In some embodiments, the single binder composition may be substantially uniformly dispersed throughout the glass mat and scrim materials. The uniformity of the single binder composition may be achieved by applying the binder composition to both the glass mat and scrim layers. In other embodiments, the single binder composition may be more concentrated in either the glass mat or the scrim material layer. The concentration of the binder composition may be achieved by applying the composition to either the glass mat or scrim layer without applying the binder composition to the other layer.

Figure 6:
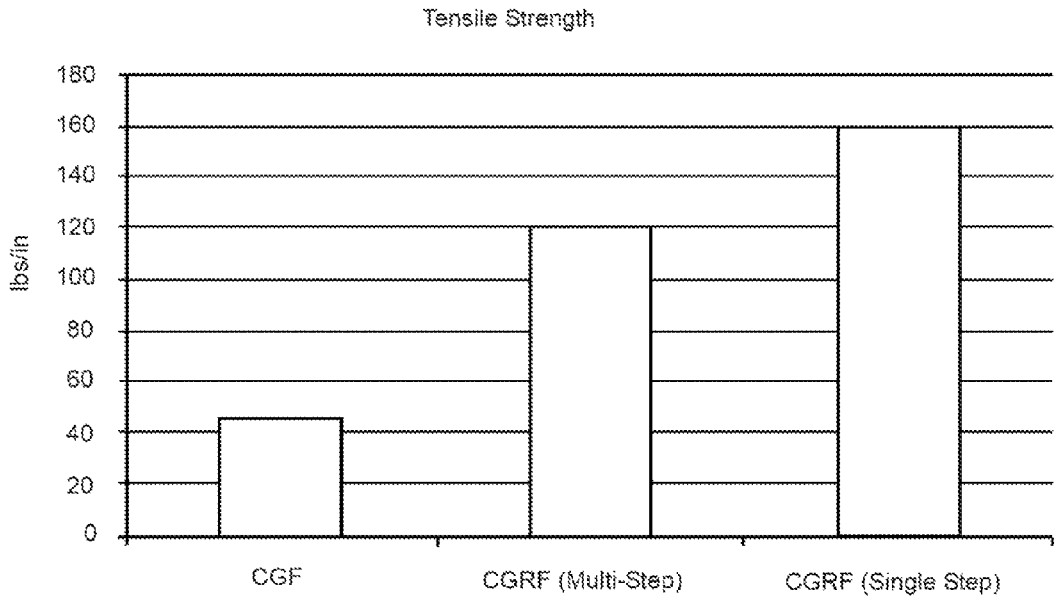
FIG. 6 illustrates a graph comparing the tensile strength of a conventional CGF facer, a conventional CGRF facer, and a CGRF facer prepared according to the embodiments described herein.

The strength of the resulting facer (CGRF facer) with the single binder composition may be greater than the strength of conventional CGRF facers (i.e., facers with multiple coatings as described above). In one embodiment, the strength of the CGRF facer made with a single binder composition may be up to about 20-40% greater than conventional CGRF facers due to an improved bond between the yarns/threads and the nonwoven glass fiber mat. For example, with reference to FIG. 6, illustrated is a graph comparing the tensile strength of a conventional CGF facer, a conventional CGRF facer prepared with multiple coating application steps (i.e., a facer with multiple coatings), and a CGRF facer prepared with a single step (i.e., a facer prepared with a single binder composition). The conventional CGF facer was formed with a coating applied to one side. The conventional CGRF facer (i.e., CGRF Multi-Step) included an 8×8 scrim having a PVC coating that was adhered to a CGF facer with an acrylic binder. The CGRF facer (Single-Step) included a glass mat that was adhered with an 8×8 scrim via a highly filled (90% mineral, 10% latex) coating applied to the scrim side. The highly filled coating was not applied to the glass mat side of the CGRF facer (Single-Step). FIG. 6 demonstrates that the conventional CGF facer achieved a tensile strength of roughly 46 lbs/in while the conventional CGRF facer achieved a tensile strength of roughly 121 lbs/in. In contrast, the CGRF facer (Single Step), such as those described herein, achieved a tensile strength of roughly 160 lbs/in, or roughly a 30% improvement in tensile strength. It is believed that application of the highly filled coating on to the glass mat side of the CGRF facer (Single-Step) would have increased the tensile strength of the facer even more.

In some embodiments, the CGRF facers having a single binder composition may also have a more substantial material coating than conventional CGRF facers meaning that the coating weight is a greater weight percentage of the resulting CGRF facer. Because such CGRF facers include a single binder composition, the yarns/threads of the scrim and the glass fibers of the nonwoven glass fiber mat are encapsulated within the same binder composition. Encapsulation of the yarns/threads and glass fibers may provide the strength improvements and/or other benefits achieved by such mats.

In some embodiments, the CGRF facer can be manufactured using conventional processes already employed to produce reinforcing scrims and coated glass mats. For example, both the glass mat and reinforcing yarns may be fed into a nip where the binder composition is applied and metered onto the glass mat before the nip or directly at the nip. Binder composition weight may be controlled via nip pressure and/or nip gap and by coating solids content. Depending on the end use application, coating penetration into the glass mat and weight may be key parameters that determine end use performance. For example, a thin, high density foam composite board may require a heavily coated CGRF with limited porosity while a gypsum composite board requires lower coat weights with greater porosity, usually tightly controlled porosity.

Exemplary Embodiments

Figure 4:
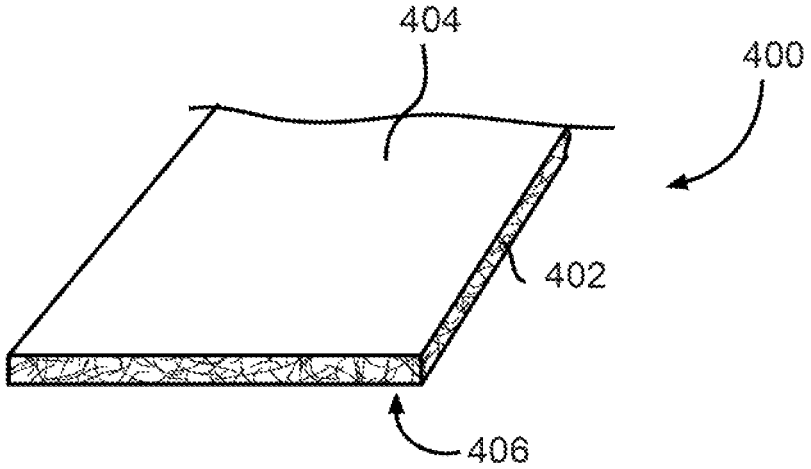
FIG. 4 illustrates an embodiment of a composite board having a facer coupled therewith.

Referring now to FIG. 4, illustrated is an embodiment of a board 400 and that includes a facer 404 attached to a surface of a core 402 or main body of the board 400. In many embodiments, a second facer 406 may be attached to an opposite surface of core 402. The core 402 of board 400 may be made of various materials including foam, gypsum, wood fiber, perlite, cement, and the like. The core 402 typically has a thickness of between 0.2 and 4 inches, a width of 2 and 4 feet, and length of 4 and 10 feet. In some embodiments (e.g., insulation foam panels), the thickness can exceed 4 inches while most other types of construction boards are between ¼ and 1 inch thick. The facer 404 and/or 406 is typically the same width and length of core 402 and commonly has a thickness of between 0.01 and 0.06 inches, although the facer 404/406 may be thicker for heavier glass mats and/or scrim layers. The facer 404/406 may be adhered or bonded with core 402 using a latex based or other adhesive material. In some embodiments, the core 402 material provides the bond to the facer 404/406 and the facer is introduced/adhered during formation of the board 400. The facer 404/406 may be coupled with core 402 to enhance one or more mechanical properties of the board 400 and/or to provide a desired exterior finish or appearance. For example, the facer 404/406 may enhance the fire resistance, wind resistance, fastener holding strength, water repellency, flexural strength, tensile strength, and the like of the board 400 and/or enhance the visual appearance of the board 400.

Referring now to FIG. 1, illustrated is an embodiment of a facer 100 that may be coupled with board 400 of FIG. 4 or any other board product. The facer 100 is a coated glass reinforced facer (CGRF—hereinafter facer 100) having a single adhesive material coating made from a binder composition as described above. Specifically, facer 100 includes a first layer of nonwoven glass fibers 102, or stated differently, includes a nonwoven fiber mat having a plurality of nonwoven glass fibers. The nonwoven fiber mat 102 may have a mat weight of between about 0.9 lb/sq and 4 lb/sq (i.e., 100 $ft^2$) and may have a thickness of between about 0.01 and 0.06 inches. The weight of the fiber mat 102 and/or thickness of the fiber mat 102 may be selected depending on the application of the facer 100.

Facer 100 also includes a scrim or second layer of reinforcement fibers 104 that is positioned on at least one surface of the fiber mat 102. The second layer of reinforcement fibers 104 includes a plurality of reinforcement yarns/threads as described above. The reinforcement fiber layer 104 strengthens or reinforces the fiber mat 102 as described above. In some embodiments, the reinforcement yarns may be arranged between about 3 and 10 yarns per inch, and more commonly 6 and 10 yarns per inch, and may have an average diameter of between 4 and 13 microns. The second layer 104 may also have a layer thickness of between about 0.005 and 0.02 inches, although thicker yarns may be used that increase the thickness of the second layer 104.

Facer 100 includes a coating that couples or adheres the first layer or fiber mat 102 and the second layer or reinforcement fiber layer 104 together. The coating is made from a binder composition that is typically dried to adhere or couple the first layer 102 and second layer 104 together. As described above, the coating is a single binder composition that coats both the first layer or fiber mat 102 and the second layer/reinforcement layer 104, as well as adheres or bonds the first layer 102 and second layer 104 together. Stated differently, the facer 104 is free of any other material coating other than the single binder composition that coats and adheres the first layer 102 and the second layer 104. In some embodiments, an additional amount of the binder composition may be applied upon drying of the first binder composition. In such embodiments, the single binder composition remains the only material that substantially coats and adheres the first layer 102 and the second layer 104.

Because the single binder composition both coats and adheres the first layer 102 and the second layer 104, the facer 100 is free of a layer of adhesive material between the first layer 102 and the second layer 104. Stated differently, a layer of a separate or another adhesive is not used at an interface 106 between the first layer 102 and the second layer 104. Rather, the single binder composition penetrates or is otherwise disposed through the first layer 102, the interface 106, and the second layer 104. In some embodiments, the binder composition is substantially uniformly dispersed throughout the coupled first layer 102 and the second layer 104, or stated differently, is substantially uniformly dispersed through the nonwoven fiber mat and reinforcement yarns/threads. Relative uniform disbursement of the binder composition through the first and second layers, 102 and 104, may be achieved by applying the binder composition to both layers before pressing and/or drying the binder composition and/or by controlling the pressure exerted on the layers, 102 and 104, by nip rollers. The uniform disbursement of the binder composition may be important depending on the use of the resulting facer 100 and board. For example, in tiling application, saturation of both the first layer 102 and second layer 104 may be desired to increase the fastener holding strength and/or improve the floor rating. In some embodiments, applying the binder composition to both sides of the facer (i.e., applying the binder composition to first layer 102 and second layer 104) may be preferred to achieve a complete saturation of the first and second layers, 102 and 104.

In other embodiments, the binder composition may be concentrated in either the first layer 102 (nonwoven fiber mat) or the second layer 104 (reinforcement fibers). In some embodiments, the binder composition may penetrate into the first layer 102 by at least 20% with a light, porous coating (gypsum). In other embodiments (e.g., a thin roofing coverboard or tile underlayment board), a heavy application will achieve at least 50% penetration into the first layer 102, or a 100% penetration when the binder composition is applied to both sides. In other embodiments, a nearly 100% penetration into the first layer 102 may be achieved via a low viscosity binder composition that is applied at a slow line speeds to only a single side. Typically, the binder composition will penetrate at least partially into the first layer 102 mat to ensure a good adhesive bond between the two layers, 102 and 104.

Concentrating the binder composition in either the first layer 102 or second layer 104 may be important depending on the application. For example, in roofing applications, it may be desirable to concentrate the binder composition in the second layer 104 (reinforcement fiber layer) to saturate the yarns with the adhesive material and adhere the yarns together in desired grid pattern. The second layer 104 is also combined with the first layer 102 in one step with adhesion to the first layer 102, which may reduce costs significantly. Concentrating the binder composition in the first layer 102 or the second layer 104 may be achieved by applying or coating only the first or second layer, 102 and 104, and/or controlling the pressure applied to the first and second layers, 102 and 104, via nip rollers. When the binder composition is applied to only one of the layers, the composition may soak, absorb, or otherwise penetrate into the other layer to some degree as the layers are pressed together via nip rollers. The penetration of the binder composition into the other layer allows the layers to adhere or bond together and/or allows the binder composition to coat the other layer as described herein. The binder composition, however, may remain concentrated in the applied layer.

In some embodiments, the binder composition may be between 30 and 95% of weight of the facer 100, and more commonly between about 60 and 95% of the weight. The weight of the binder composition may be determined based on the desired use of the facer 100 and board. For example, the binder composition that is applied may be dependent on a desired porosity of the facer 100. In some instances, it may be desired to have a porous facer 100, such as for gypsum, cement, and/or perlite boards. In other instances, it may be desired to minimize the porosity of the facer 100, such as for foam boards. In addition to bonding or adhering the glass fibers, in some embodiments, the binder composition may include one or more filler materials that enhance the mechanical properties of the facer and/or the visual appearance of the facer. For example, the binder composition may include a fire retardant, water repellant, pigment, and the like to enhance the facers ability to resist burning, to repel water, or to achieve a desired color or appearance, and the like. In some embodiments, the facer 100 may have or exhibit a strength of at least 60 lbs/in and up to 150 lbs/in or more, which may be greater than the strength achievable with conventional CGRF facers.

Although not shown, in some embodiment, a third layer of reinforcement fibers could be adhered to an opposite surface of the first layer 102 so that the first layer 102 is sandwiched between two layers of reinforcement fibers. The reinforcement fibers of the third layer may be the same as or different than the reinforcement fibers in the second layer 104. In another embodiment, a third layer of nonwoven glass fibers may be adhered to an opposite surface of the second layer 104 so that the second layer is sandwiched between two nonwoven glass mats. The nonwoven glass fibers of the third layer may be the same as or different than the nonwoven glass fibers of the first layer 102. The three layer facer configuration may be applied in a single step as described herein. Stated differently, the three layer facer may use a single binder composition as described herein. The single binder composition may be roughly uniform throughout the three layers, or may be concentrated in one or two of the layers as desired (i.e., concentrated in the $1^{st}$ layer, the $2^{nd}$ layer, the $3^{rd}$ layer, the $1^{st}$ and $2^{nd}$ layer, the $2^{nd}$ and $3^{rd}$ layer, the $1^{st}$ and $3^{rd}$ layer, and the like).

Exemplary Processes

Figure 2:
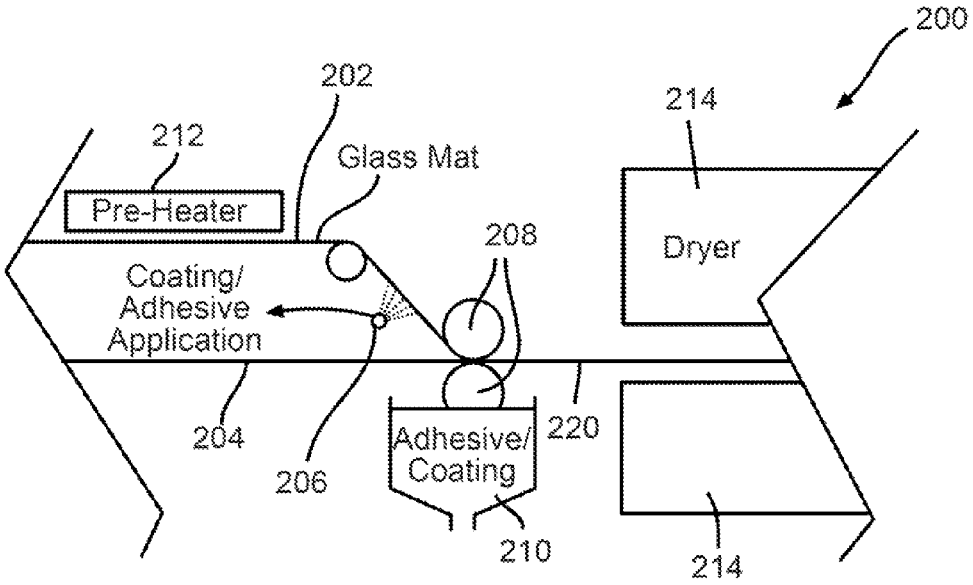
FIG. 2 illustrates a process for manufacturing a CGRF facer.

Referring now to FIG. 2, illustrated is a process 200 for manufacturing a CGRF facer. According to the process 200 a glass mat 202 or a first layer of nonwoven glass fibers (or other fibers) is formed. Formation of the glass mat may involve passing liquid glass through apertures of a plate and/or through a spinner device onto a moving plate or assembly. The glass fibers may be subject to a cross-stream quenching airflow upon passing through the aperture plate and/or spinner device. The diameter and/or length of the glass fibers may be controlled through this process. In some embodiments, the glass mat 202 may have a weight of between 0.9 lb/sq and 4 lb/sq, a fiber diameter of between 6 and 20 microns, and a fiber length of ½ to 1 inch.

The formed glass mat 202 may be exposed to a pre-heater 212 to help reduce a penetration of the binder composition into the glass mat 202 and/or help keep the glass mat 202 and fibers 204 together before drying. A second layer of reinforcement fibers 204 may be formed by a weaving machine that weaves the threads/yarns in a machine and/or cross machine direction. In some embodiments, the reinforcement fibers or yarns may be arranged between about 6 and 10 yarns per inch to form the second layer 204. The reinforcement yarns may also have an average diameter of between 4 and 13 microns. In other embodiments, a nonwoven reinforcement layer may be used in place of the woven reinforcement layer, or the reinforcement layer may include yarns/threads that are arranged in only one direction (i.e., the machine or cross-machine direction). In other embodiments, the reinforcement layer may include yarns/threads that are arranged in a diagonal direction. The glass mat 202 and/or reinforcement layer 204 may be guided by one or more rollers.

The glass mat 202 and/or reinforcement layer 204 may be coated with a binder composition. In some embodiments, a spray applicator 206 may be used to coat the glass mat 202 with the binder composition. In some embodiments, the glass mat 202 may be coated with the binder composition via spray application 206 without coating the reinforcement layer 204 when it is desired to concentrate the binder composition within one of the layers. In other embodiments, both layers, 202 and 204, may be coated when a relatively uniform and/or saturated coating of the binder composition.

In some embodiments, the binder composition may be applied via a reservoir 210 of the composition. The reservoir 210 may be positioned under a roller that presses against and/or guides either the glass mat 202 or reinforcement layer 204. The binder composition may be coated on the roller as the roller spins and may be transferred to the glass mat 202 and/or reinforcement layer 204 via the roller. In some embodiments, the reservoir 210 may be used in place of the spray applicator 206, while in other embodiments the reservoir 210 may be used in addition to the spray applicator 206. The coating of the binder composition via the reservoir 210 may be controlled by controlling the submersion of the roller within the reservoir 210 and/or the rotational speed of the roller. In some embodiments, the glass mat 202 and reinforcement layer 204 may be substantially simultaneously coated with the binder composition.

It should be noted that prior to the application of the binder composition, neither the glass mat 202 nor the reinforcement layer 204 are coated with a binder or other material coating. Stated differently, prior to the application of the binder composition, the glass mat 202 and the reinforcement layer 204 are free of a binder or other material coating. As such, the binder composition is the only material that coats and adheres the glass mat 202 and reinforcement layer 204, unlike conventional CGRF facers that include multiple coatings and/or an adhesive material layer between the separately coated layers.

The reinforcement layer 204 is positioned atop, or on at least one surface, of the glass mat 202. Positioning the reinforcement layer 204 on the surface of the glass mat 202 may be performed prior to or after the binder composition is applied. Excess binder composition may be metered off by using one or more metering blades and/or by controlling a pressure exerted on the glass mat 202 and/or reinforcement layer 204 by one or more of the rollers. A gap between rollers may be controlled to vary the pressure exerted on the glass mat 202 and/or reinforcement layer 204 and thereby control the coating by the binder composition. The glass mat 202 and reinforcement layer 204 may be passed through nip rollers 208 that press the glass mat 202 and reinforcement layer 204 together to form a CGRF facer 220 having a single binder composition. In some embodiments, pressing the reinforcement layer 204 and glass mat 202 together may cause the yarns/threads to spread out to some degree across the surface of the glass mat 202, which may increase the surface area of the yarns/threads about the glass mat 202. This may reduce weak areas, reduce the overall thickness, and/or enhance the uniformity of the cross-section of the facer 220. In some embodiments, the rollers 208 that press the glass mat 202 and reinforcement layer 204 together may also function to apply the binder composition. In such embodiments, pressing of the layers together and application of the binder composition may occur essentially simultaneously.

The formed CGRF facer 220 is then dried in an oven or dryer device 214 to adhere, couple, or otherwise bond the glass mat 202 and the reinforcement layer 204 together. The facer 220 should be dried quickly after application of the binder composition and/or pressing of the layer via the rollers 208 to prevent separation of the glass mat 202 and reinforcement layer 204. Since the glass mat 202 and reinforcement layer 204 do not have a prior binder coating, the layers are not as stable as those used for conventional facers. To prevent uncoupling of the layers, 202 and 204, in some embodiments an IR heater and/or heated rollers may be used directly after the binder composition is applied. The facer 220 may then be coupled with a composite board to reinforce the composite board and/or enhance one or more characteristics of the board as described herein. The composite board may be made of foam, gypsum, wood fiber, perlite, cement, and the like. In some embodiments (e.g., for non-porous facers), a second application of binder composition may be applied to the facer 220. The second application of binder composition may be dried subsequent to its application. In such embodiments, two application heads for the binder composition and two drying processes may be used and/or performed.

Figure 3:
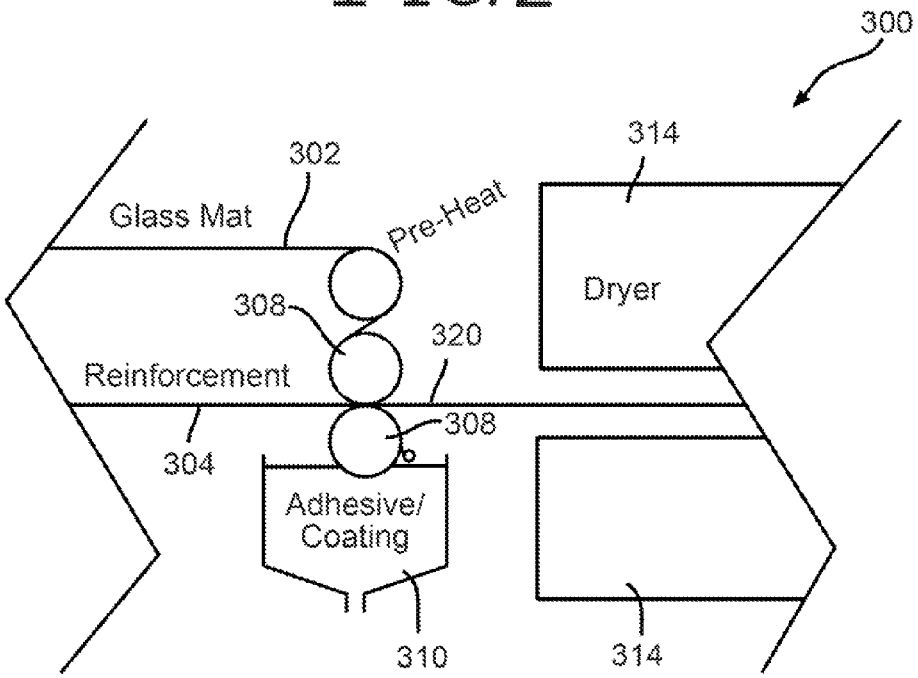
FIG. 3 illustrates a another process for manufacturing a CGRF facer.

Referring now to FIG. 3, another process 300 for preparing a CGRF facer is provided. According to the process 300 a first layer of fibers 302 is formed using any technique known in the art. The first layer of fiber 302 is pulled and/or guided via one or more rollers. A second layer of reinforcement fibers 304 is also formed and positioned on at least one surface of the first layer of fibers 302. The first layer 302 and the second layer 304 are then passed through nip rollers 308 that press the layers together and/or apply a binder composition. One or more of the rollers 308 may be in contact with a reservoir 310 that contains the binder composition. The coated layers, 302 and 304, form a CGRF facer 320 having a single coating of binder composition. The facer 320 is then dried via dryer device 314. The facer 320 may be subsequently coupled with a board to reinforce the board and/or enhance one or more properties of the board as described herein.

Although not illustrated herein, it should be realized that in some embodiments a second reinforcement layer of fibers may be positioned on an opposite side of the first layer (e.g., glass mat) so that the first layer is sandwiched between two reinforcement layers. In some embodiments, a knife or blade can be used in place or in addition to the roller nips to meter the coating of the binder composition while combining the nonwoven fiber mat and reinforcement yarns. In some embodiments, a puddle of the binder composition may be positioned behind a flexible blade or knife. In such embodiments, the flexible blade or knife may press the nonwoven fiber mat and reinforcement yarns together and the binder composition may be applied immediately after the layers are pressed together. In another embodiment, a knife or blade may be positioned distally of the roller nips to meter excess binder composition and/or produce a smoother surface. In some embodiments, the coating of the binder composition may be controlled by controlling the pressure of a flexible (or rigid) blade that contacts the nonwoven fiber mat and/or reinforcement yarns. A flexible knife may be preferred over a rigid knife due to the mineral fillers and rough surface created by reinforcement yarn layer.

Exemplary Binder Compositions

Inorganic Binder Compositions

As noted above, exemplary binder compositions may include inorganic binder compositions that include one or more silicate compounds, such as sodium silicates, potassium silicates, sodium-potassium silicates, and ammonium silicates, among other types of silicate compounds. The inorganic binder compositions may also include water, one or more fillers, surfactants, dispersants, and thickeners, among other additional binder components. It should be appreciated that the inorganic binders may include organic compounds, such as organic polymer latexs and polyols that act as plasticizers to increase the flexibility of the binder. Thus, the term "inorganic binder composition" refers to binders having a significant or predominant portion of an inorganic compound (e.g., an alkali-metal silicate) in the non-filler and non-water portion of the binder composition, but does not exclude the presence of organic compounds.

When the silicate compound is a sodium silicate it may be added to the binder composition through a liquid (i.e., aqueous) sodium silicate solution. These solutions are often identified by the molecular weight ratio (also called the "modulus") of silicon oxide ($SiO_2$) to sodium oxide ($Na_2O$) in the silicate, where the molecular weight of the "$SiO_2$" represents the average molecular weight of the silicate species present in the sodium silicate solution. Commercial sodium silicate solutions typically have a $SiO_2/Na_2O$ modulus ranging from 1.5 to 3.2. As the modulus increases, the silicon species are more concentrated and the binder composition is generally less hydroscopic, making it easier to dry into a glassy film. On the other hand, the water absorbed by more hydroscopic low-modulus silicate binder compositions tends to make the binders formed from those compositions more flexible and less brittle.

Sodium silicate binder compositions can be transformed into a binder for the glass mat and/or reinforcement layer by (1) heating and dehydrating the composition, (2) gelling/polymerizing the silicate compounds, and (3) precipitating the sodium silicates by reaction with multivalent metal cations such as $Ca^{2+}$, $Mg^{2+}$, $Zn^{2+}$, $Al^{3+}$, and $Fe^{3+}$, among other ions, that can be supplied by salts of these ions such as halide, sulfate, and phosphate salts, among other salts. These transformation techniques (also called curing techniques) may not form binders with identical physical characteristics even when the same binder composition is used.

For example, the heating/dehydrating technique is well suited for forming strongly adhesive glassy films while the gelling/polymerizing technique tends to form binders with less adhesive strength but more water resistance than those formed by heating/dehydrating the sodium silicate binder composition.

When the binder is formed by heating and dehydrating a sodium silicate binder composition, the composition becomes progressively more tacky and viscous until finally solidifying into a hard, glassy binder. In order to reduce the rigidity of the binder, the binder compositions may also include plasticizers to make the binder more flexible and less fracture prone. Exemplary plasticizers may include organic latex polymers such as polyacrylic latex, polyvinyl acetate latex, polyethylene-vinyl acetate latex, polyethylene-vinyl chloride latex, polyvinyl chloride latex, styrene-butadiene latex, polystyrene acrylic latex, polyvinyl acrylic polyurethane latex, and acetate-ethylene-acrylate terpolymer latex, among other types of organic latex polymers. They may also include polyols such as polyethylene glycol, carbohydrates, diethylene glycol, glycerin and sorbitol, among others. When hydrophobic plasticizers are made from non-polar organic oligomers and polymers, they may also increase the binder's water resistance.

Binders formed by gelling/polymerizing a sodium silicate binder composition typically use one or more acids to lower the pH of the composition and cause the silicate species to crosslink and polymerize. Exemplary acids may include inorganic acids such as hydrochloric acid, sulfuric acid, phosphoric acid, sodium bicarbonate, monosodium phosphate, and even carbon dioxide; as well as organic (carboxylic) acids. Sodium silicate solutions have significantly high pH (e.g., pH greater than 10), and get progressively more alkaline as the $SiO_2/Na_2O$ modulus decreases. Thus, the strength and concentration of the acid needed to start a gelation/polymerization of the sodium silicate binder composition can be relatively low. The acids may even be provided by fillers such as Kaolinitic clays that decompose into acidic compounds at raised temperatures (e.g., 400-500° F.).

Binders formed by precipitating a sodium silicate binder composition through reaction with multivalent metal cations can made through the combination of the silicate binder composition with an aqueous solution of one or more multivalent metal salts. The insoluble metal-silicates generally precipitate rapidly, and the multivalent metal salts solution is frequently applied after the binder composition has wet the substrate. Calcium chloride, magnesium sulfate, aluminum sulfate, borax, and sodium metaborate used in this manner are generally applied as 5 to 10% solutions, Chemical setting agents that dissolve slowly in water, such as finely divided zinc oxide or sodium silica fluoride, can be used for silicate binders or coatings that exhibit longer working lives. These agents usually are used at a level of approximately 7% by weight based on the weight of liquid silicate, Silico fluoride may be particularly effective for ambient temperature curing procedures.

The fillers used in the exemplary inorganic binder compositions may include solid inorganic materials, such as kaolinitic clay, mica, talc, limestone (calcium carbonate), fly ash, gypsum (calcium sulfate), montmorillonite, smectite and chlorite, among others. In addition to acting as a filler, the platelet structure of mica can also reduce the permeability of the binder by covering holes and blocking channels in the binder.

The binder composition may also include viscosity modifying compounds that make the composition more or less viscous depending on the compound and the needs of the binder composition. When the binder composition is too viscous, or can become too viscous, to effectively wet the fibers in one or more of the facer layers, the viscosity modifying compound can be a surfactant that reduces the surface tension of the binder composition so it may more easily wet the fibers in the glass mat and/or reinforcement layer. Exemplary surfactants may include silicate-compatible anionic and/or non-ionic surfactants. When the binder composition is not viscous enough, the viscosity modifying compound can be a thickening agent (a.k.a. thickener) such as xanthan gum, hydroxyethyl cellulose (HEC), and/or carboxymethyl cellulose (CMC), among other thickening agents.

In general, the amount of silicate in the binder composition may range from about 4% to about 12% based on the total dry weight of the coating. Another exemplary silicate concentration range is about 6% to about 9%. When an organic plasticizer it may be added in dry weight can range from 1 to 30% by weight based on dry weight of the silicate, Other exemplary ranges include 5 to 30% by weight, and 10 to 20% by weight.

Table 1 below provides some concentration ranges for exemplary inorganic binder compositions that may be used with the present facers and composite boards:

TABLE 1

Components of Exemplary Inorganic Binder Compositions

| Binder Component | Concentration |
|---|---|
| Alkali-Metal Silicate | 4-12 wt. % (based on dry weight of coating) |
| Water | 25-50 wt. % (based on total binder composition weight) |
| Filler Materials | 50-95 wt. % (based on the dry weight of the coating) |
| Other Components | 1-38 wt. % (based on the dry weight of the coating) |

The other components may include one or more plasticizers (1-10 wt. %), flame retardants (0-20 wt. %), dispersants (0-1 wt. %), surfactants (0-1 wt. %), and thickeners (0-10 wt. %) among other compounds. The filler materials listed in Table 1 may include a single filler material, or may include more than one kind of filler. For example, the filler may include a primary filler that makes up 51-99 wt. % (based on the total weight of filler materials) and a secondary filler that make up 1-49 wt. % of the filler materials. Exemplary primary fillers may include calcium carbonate, perlite, clay, and gypsum, among other fillers. Exemplary secondary fillers may include clay, mica, talc, expanded perlite fines, fumed silica, fly ash, fiber glass, vermiculite, titanium dioxide, and zinc oxide, among other fillers.

Organic Binder Compositions

Exemplary organic binder compositions include one or more organic polymers, one or more fillers, and water. The exemplary organic polymers may include an organic polymer latex chosen from polyacrylic latex, polyvinyl acetate latex, polyethylene-vinyl acetate latex, polyethylene-vinyl chloride latex, polyvinyl chloride latex, styrene-butadiene latex, polystyrene acrylic latex, polyvinyl acrylic polyurethane latex, and acetate-ethylene-acrylate terpolymer latex, among others. The binder compositions may also include fire retardants such as phosphorous-containing flame retardants. Exemplary phosphorous-containing flame retardants may include polyphosphates, and organophosphorous compounds such as phosphate esters and phosphate amides.

Examplary CGRF Facers

Figure 5:
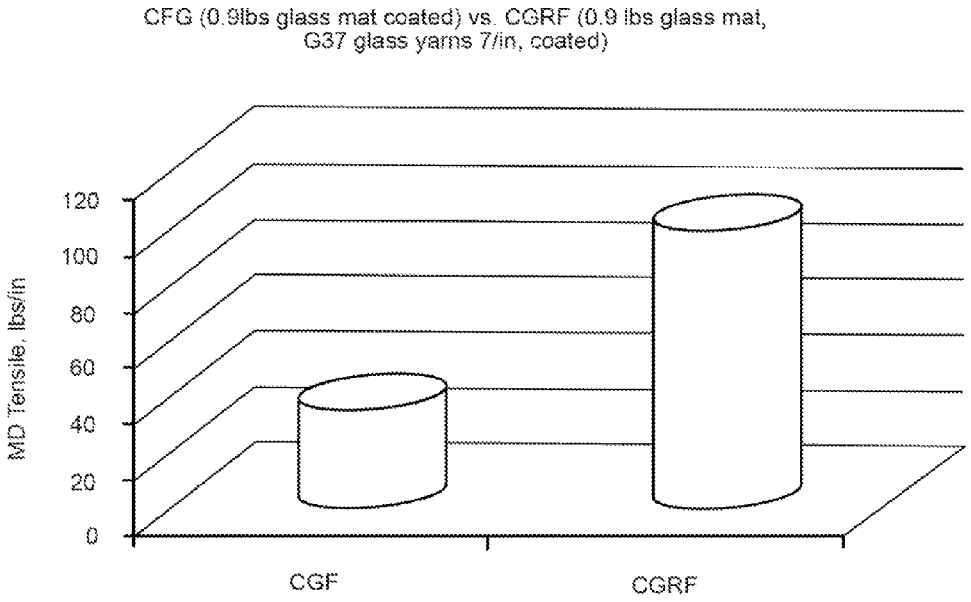
FIG. 5 illustrates a graph comparing the tensile strength of a coated glass facer (CGF) and a coated glass reinforced facer (CGRF).

A CGRF facer was formed and compared with a similar unreinforced facer (i.e. a coated glass facer CGF). The CGRF facer was constructed using a 0.9 lb/sq glass mat, G37 yarn at approximately 7 yarns per inch, and an inorganic binder consisting of calcium carbonate, sodium silicate, latex, a viscosity modifier, and a dispersant. A similar mat was constructed, but without the G37 yarn reinforcement. The tensile strength of the two facers were tested and the results are provided in FIG. 5. As shown in FIG. 5, a CGRF facer can easily increase tensile strengths by 200% or more over a coated glass facer constructed with same glass mat and binder composition.

EXAMPLE

An 8,000 pound batch of an inorganic binder composition is made by adding 1296 pounds of water to a mixing tank mounted with heavy duty disperser, followed by 959 lbs 3.2 modulus sodium silicate (38% solid) and 149 lbs polyvinylacrylate latex Duracet 864 (50% solid): 2.5 lbs defoamer and 30 lbs water repellant of Sequapel 409. The mixture is very well mixed and followed by adding 3240 lbs of White 10 and 2323 lbs Atornite to make the binder composition. The well-mixed binder composition has 75% solid content and 5:1 ratio of solium silicate to polymer and 12.7:1 ratio of filler to dry binder.

The inorganic binder composition is applied to a glass mat and heat cured. Several physical properties of the inorganic binder-containing glass mat are measured and compared to a second glass mat that has a purely organic binder made from an organic latex polymer. The comparative results are shown in Table 2:

TABLE 2

Physical Properties of Coated Glass Mats

| Property Measured | Coated Glass Mat with Inorganic Binder of Ex. 1 | Coated Glass Mat with Organic Latex Coating |
|---|---|---|
| Coat Weight - max (gsm) | 460 | 500 |
| Compressive Strength (psi) | 139 | 112 |
| Flexural Load MD (lbs) | 43 | 35 |
| Flexural Strength MD (psi) | 3085 | 2486 |
| Flexural Load CMD (lbs) | 40 | 39 |
| Flexural Strength CMD (psi) | 2883 | 2804 |
| Alkali Resistance (pass/fail) | Pass | Pass |
| Glass Mat | 7512 | 7512 |

As can be seen from Table 2, the performance characteristics of the silicate coated mat, including flexibility, are comparable to that of the latex-containing commercial mat. The silicate coated mat also has improved fire and mold resistance. Additional experimental details can be found in co-assigned U.S. Pat. No. 7,833,638, the entire contents of which is herein incorporated for all purposes.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A method of forming a facer for bonding with a composite board, the method comprising:

providing a nonwoven fiber mat, the nonwoven fiber mat including a plurality of interwoven glass fibers and having a weight of between 0.9 lb/sq and 4 lb/sq;

providing a plurality of reinforcement yarns, the reinforcement yarns being arranged between about 6 and 10 yarns per inch and having an average diameter of between 4 and 13 microns;

coating the nonwoven fiber mat and the reinforcement yarns with a binder composition, the binder composition comprising between 50 and 75% solid materials and between 25 and 50% water;

pressing the coated nonwoven fiber mat and the reinforcement yarns together between a pair of roller nips; and drying the nonwoven fiber mat and the reinforcement yarns to remove the water from the binder composition and thereby couple the nonwoven fiber mat and the reinforcement yarns together to form the facer with the binder composition being substantially uniformly dispersed throughout the coupled nonwoven fiber mat and reinforcement yarns.

2. The method of claim 1, wherein coating the nonwoven fiber mat and the reinforcement yarns comprises applying the binder composition prior to pressing the coated nonwoven fiber mat and the reinforcement yarns together.

3. The method of claim 2, wherein applying the binder composition comprises spraying the binder composition onto the nonwoven fiber mat.

4. The method of claim 1, further comprising applying the binder composition while pressing the nonwoven fiber mat and the reinforcement yarns together.

5. The method of claim 4, wherein applying the binder composition comprises coating one or more of the roller nips with the binder composition.

6. The method of claim 1, further comprising adhering the facer to a composite board, the composite board including one or more materials selected from the group consisting of:

foam;

gypsum;

wood fiber;
perlite; and
cement.

7. The method of claim 1, further comprising controlling the coating of the binder composition of the coupled nonwoven fiber mat and reinforcement yarns by controlling the pressure exerted on the materials by the roller nips and/or controlling a gap between the roller nips.

8. The method of claim 1, wherein the binder composition is an inorganic binder composition.

9. The method of claim 8, wherein the inorganic binder composition comprises at least one sodium silicate compound.

10. The method of claim 1, wherein the solid materials in the binder composition comprise:

about 4 to about 12 wt. % alkali-metal silicate;
about 50 wt. % to about 95 wt. % filler material; and
about 1 wt. % to about 38 wt. % of one or more binder components chosen from a plasticizer, a flame retardant, a dispersant, a surfactant, and a thickener.

11. The method of claim 10, wherein the filler material comprises two or more different filler materials.

12. The method of claim 10, wherein the plasticizer comprises an organic latex polymer.

13. A method of forming a facer comprising:

forming a first layer of nonwoven polymer fibers, the first layer of nonwoven polymer fibers having a weight of between 0.9 lb/sq and 4 lb/sq;

positioning a second layer of reinforcement yarns atop the first layer of nonwoven polymer fibers, the second layer of reinforcement yarns being arranged between about 6 and 10 yarns per inch and having an average diameter of between 4 and 13 microns;

coating the first layer of nonwoven polymer fibers and the second layer of reinforcement yarns with a binder composition, the binder composition comprising between 50 and 75% solid materials and between 25 and 50% water;

pressing the coated first layer of nonwoven polymer fibers and the second layer of reinforcement yarns together between a pair of rollers; and drying the first layer of nonwoven polymer fibers and the second layer of reinforcement yarns to remove the water from the binder composition and thereby couple the first layer of nonwoven polymer fibers and the second layer of reinforcement yarns together to form the facer with the binder composition being substantially uniformly dispersed throughout the coupled first layer of nonwoven polymer fibers and the second layer of reinforcement yarns.

14. The method of claim 13, wherein the binder composition is applied to either the first layer of nonwoven polymer fibers or the second layer of reinforcement yarns, but not both layers, prior to pressing the layers together.

15. The method of claim 13, wherein coating the first layer of nonwoven polymer fibers and the second layer of reinforcement yarns comprises applying the binder composition prior to pressing the coated materials together.

16. The method of claim 15, further comprising applying the binder composition while pressing the layers together.

17. The method of claim 15, wherein applying the binder composition comprises spraying the binder composition onto the first layer of nonwoven polymer fibers.

18. The method of claim 16, wherein applying the binder composition comprises coating one or more of the roller with the binder composition.

19. The method of claim 13, further comprising adhering the facer to a composite board, the composite board including one or more materials selected from the group consisting of:

foam;
gypsum;
wood fiber;
perlite; and
cement.

20. The method of claim 13, further comprising controlling the coating of the binder composition of the coupled first layer of nonwoven polymer fibers and the second layer of reinforcement yarns by controlling the pressure exerted on the materials by the rollers and/or controlling a gap between the roller.

21. The method of claim 13, wherein the binder composition is an inorganic binder composition.

22. The method of claim 21, wherein the inorganic binder composition comprises at least one sodium silicate compound.

23. The method of claim 13, wherein the solid materials in the binder composition comprise:

about 4 to about 12 wt. % alkali-metal silicate;
about 50 wt. % to about 95 wt. % filler material; and
about 1 wt. % to about 38 wt. % of one or more binder components chosen from a plasticizer, a flame retardant, a dispersant, a surfactant, and a thickener.

24. The method of claim 23, wherein the filler material comprises two or more different filler materials.

25. The method of claim 23, wherein the plasticizer comprises an organic latex polymer.

26. The method of claim 1, wherein the nonwoven fiber mat includes a plurality of interwoven polymer fibers.

27. The method of claim 13, wherein the first layer of nonwoven polymer fibers also includes glass fibers.

* * * * *